US005337766A

United States Patent [19]

Lane

[11] Patent Number: 5,337,766

[45] Date of Patent: Aug. 16, 1994

[54] FLOATABLE TOOTHPICK ASSEMBLY

[76] Inventor: Terry Lane, 1925 Brickell Ave., Apt. D810, Miami, Fla. 33129

[21] Appl. No.: 116,577

[22] Filed: Sep. 7, 1993

[51] Int. Cl.[5] ..... A45D 8/18

[52] U.S. Cl. ..... 132/329; 132/321; D7/683; D7/684

[58] Field of Search ..... 132/321, 329; 366/129, 366/343; D7/635, 636, 683, 684; D1/102, 104, 105; D3/6; 239/33; 99/419; 294/61; D28/64

[56] References Cited

U.S. PATENT DOCUMENTS

| | | | |
|---|---|---|---|
| D. 207,412 | 4/1967 | La Barbera | D7/684 |
| 1,253,579 | 1/1918 | Deanes | 239/33 |
| 1,916,646 | 7/1933 | Tycko | 239/33 |
| 1,991,871 | 2/1935 | Sindler | D7/683 |
| 3,078,856 | 2/1963 | Bender et al. | 132/321 |
| 3,099,565 | 7/1963 | Neuhauser | 239/33 |
| 3,646,628 | 3/1972 | Halford | 132/329 |

FOREIGN PATENT DOCUMENTS

| | | | |
|---|---|---|---|
| 471232 | 5/1952 | Italy | 239/33 |
| 7908774 | 7/1981 | Netherlands | 239/33 |

*Primary Examiner*—Gene Mancene
*Assistant Examiner*—Frank A. LaViola
*Attorney, Agent, or Firm*—Malloy & Malloy

[57] ABSTRACT

A toothpick assembly which includes a pointed lower end to piercingly connect to a piece of garnish, such as an olive or a cherry, and a buoyant float about the toothpick and adjacent the upper end of the toothpick to float a piece of garnish in a beverage which can be retrieved by grasping the upper end of the toothpick.

10 Claims, 1 Drawing Sheet

FIG. 1
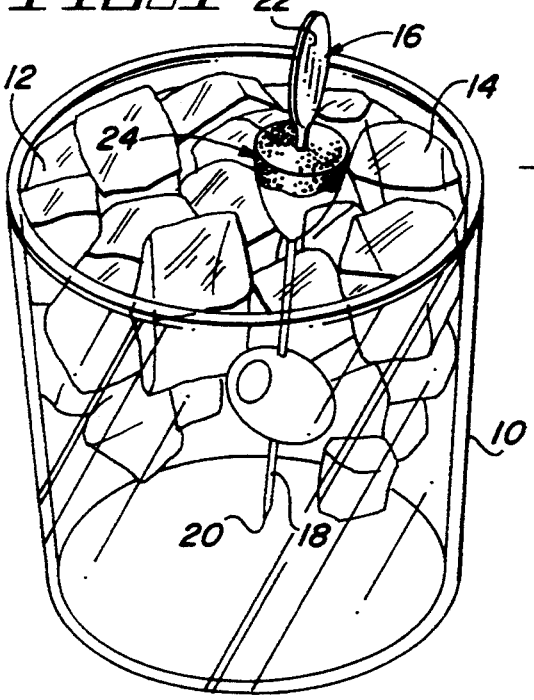
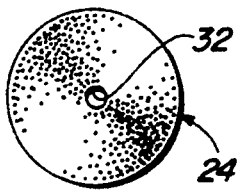
FIG. 2
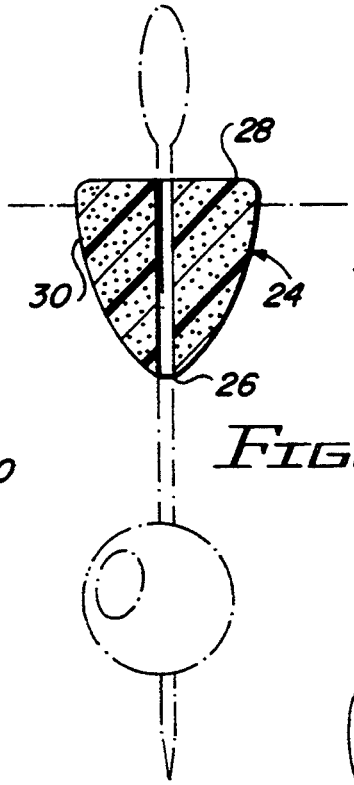
FIG. 3
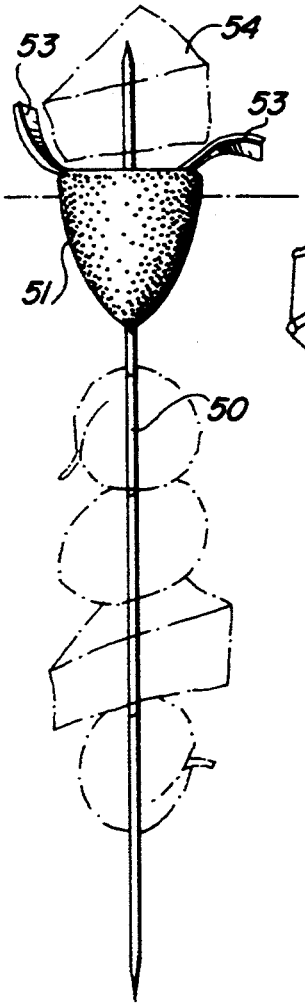
FIG. 5
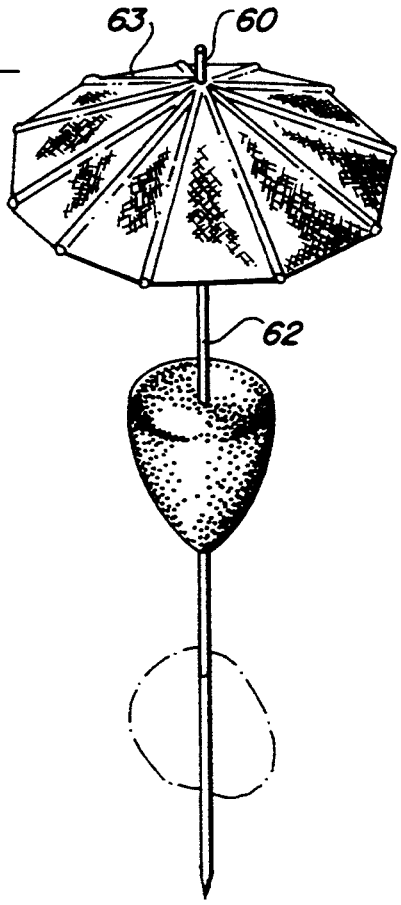
FIG. 6
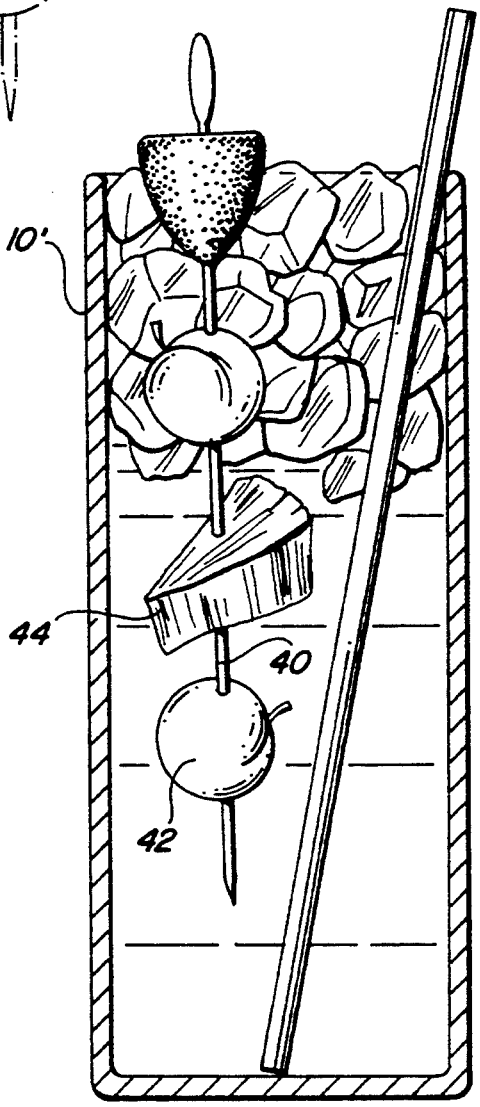
FIG. 4

FLOATABLE TOOTHPICK ASSEMBLY

FIELD OF THE INVENTION

This invention relates to a toothpick assembly which includes a toothpick and a float adjacent the upper end of the toothpick and a pointed opposite lower end to piercingly engage a piece of garnish, such as a cherry or olive, so that the garnish may be easily removed from a beverage and eaten.

BACKGROUND OF THE INVENTION

It has often been noticed that persons sometimes like to eat a cherry or an olive in an alcoholic beverage particularly. Often times, it is fairly difficult to do this because retrieval of the piece of garnish is somewhat difficult. Often people are observed using spoons, forks, or indeed their fingers in order to reach into a drink and retrieve the piece of garnish.

SUMMARY OF THE INVENTION

This invention is of a toothpick which includes an elongate length segment having a first or lower end zone with a pointed tip to attach garnish to it and a second opposite upper end zone, the toothpick being generally cylindrical in cross-section and of uniform diameter between its end zones; and it includes a buoyant symmetrical float with an upper surface, a lower end, and surface extending between the upper surface and lower end, the float, in use, being disposed adjacent the upper toothpick end zone. The float has sufficient buoyancy to float the assembly in a beverage with the upper end of the toothpick extending above and out of the beverage when a garnish is piercingly captivated on the lower end of the toothpick assembly so that the garnish may be removed by clasping the accessible toothpick upper end.

It is generally an object of this invention to provide an assembly of the type described which is simple and inexpensive in construction and well adapted for the purposes set forth herein, primarily for ease of removal of the garnish from a beverage.

BRIEF DESCRIPTION OF THE DRAWINGS

For a fuller understanding of the nature of the present invention, reference should be had to the following detailed description taken in connection with the accompanying drawings, in which:

FIG. 1 is a perspective view of a beverage in a glass with a floating toothpick assembly according to this invention having a garnish on the lower end and a float means adjacent the upper end, so that the upper end extends above the liquid.

FIG. 2 is a sectional view of the float.

FIG. 3 is a view in cross-section illustrating the float in a preferred embodiment.

FIG. 4 is a slightly modified embodiment of the invention illustrating the float means on a somewhat elongate toothpick.

FIG. 5 is a view illustrating a toothpick assembly with a handle means at the upper end for lifting it from the upper surface of beverage in a glass and which can be used to cradle a piece of garnish.

FIG. 6 is a perspective view illustrating an alternative embodiment of the instant invention.

Like reference numerals refer to like parts throughout the several views of the drawings.

DESCRIPTION OF THE PREFERRED EMBODIMENT

In FIG. 1, there is shown a glass 10 having ice cubes such as 12 and beverage indicated at 14 at its upper surface or what could be termed the upper float line. Within the glass, there is a toothpick assembly generally indicated by the numeral 16 which is seen to include a toothpick or elongate length segment 18 having a lower pointed end as at 20 and an upper end zone as at 22. On the length of the toothpick assembly, there is a float means 24. The float 24 is shown in FIGS. 2 and 3. In a preferred embodiment, it is symmetrical with respect to a vertical center line extending between the bottom end of the float 26 and its upper surface 28. The side surface of the float is designated by the numeral 30. There is a central through bore 32 between the lower end and the upper surface to jacket a toothpick along its elongate length, slidably, so that the float 24 can be adjusted to a position adjacent the upper end 22 as seen in FIG. 1. In an alternative embodiment, the toothpick assembly is integrally formed with the float 24, thereby making a single non-adjustable piece. Both can either be molded of the same material or of two different materials with the float 24 being fixedly secured to the toothpick assembly.

In use, a garnish is pierced by the tapered and pointed lower end and, as indicated in FIGS. 1 and 3, dropped into the glass. It will float in the attitude shown in FIG. 1 where it can be easily removed by lifting it from the glass using the upper end to clasp it and retrieve the garnish. The overall length of the toothpick is between about 2½ inches and 4½ inches and its cross-sectional diameter between the end zones is between 1/16 of an inch and ⅛ of an inch. In the embodiment shown in FIG. 4, a somewhat elongate toothpick is shown at 40 for a somewhat taller glass indicated by the numeral 10'. In this case, garnish as indicated which may be in the form of a cherry 42 and a piece of pineapple for example, as indicated at 44. In the embodiment shown in FIG. 5, the elongate toothpick length 50 is provided extending upwardly from the float 51 with handle means which can be clasped to lift the toothpick assembly with garnish on it from a glass with a beverage in it, the handle means being designated by the numeral 53; and, prior to use, it is adapted to cradle a piece of garnish such as the pineapple slice indicated at 54.

Finally, in the embodiment shown in FIG. 6, the upper end 60 of the elongate toothpick length 62 may be provided with a decorative portion such as a parasol 63 while the lower end, as indicated, is used to pierce a piece of garnish. In a preferred embodiment, the upper surface of the float means is between about ½ of an inch and ¾ of an inch in diameter with the side wall tapering symmetrically to the lower end as indicated preferably in a curved decorative design. While the float may be of any desired material, it is only required that it have sufficient buoyancy so that its upper surface is at about the level of the drink when it is served; and, therefore, the end opposite to the pointed lower tip will extend out of the water so that it can be grasped, the assembly floating in a generally upright position with garnish on the lower end so that access can be had to it conveniently by a user.

While this invention has been shown and described in what is considered to be a practical and preferred embodiment, it is recognized that departures may be made within the spirit and scope of this invention which should therefore not be limited except as set forth in the claims and within the doctrine of equivalence.

What is claimed is:

1. A toothpick assembly comprising an elongate length segment having a first lower end zone with a pointed tip, a first upper opposite end zone and a main length of generally cylindrical cross-section between the end zone, a buoyant float means with a) an upper surface, b) a lower end, and c) a side surface extending between the upper surface and the lower end, said float means being disposed on said main length adjacent said first upper opposite end zone, and said float means being sufficiently buoyant to float in a beverage with the first upper opposite end zone extending above a top level of the beverage when a garnish is piercingly captivated adjacent the first lower end zone, and said first upper opposite end zone being structured and disposed to provide an accessible finger gripping surface for use in lifting the assembly and the garnish thereon from a floating disposition in the beverage.

2. An assembly as set forth in claim 1 wherein the float means includes a through bore sized to snugly receive the main length therein for sliding movement of adjustment between the end zones along the main length to a position adjacent the second upper opposite end zone.

3. An assembly as set forth in claim 1 wherein the second first upper opposite end zone is tapered to a pointed end.

4. An assembly as set forth in claim 1 wherein the elongate length segment is of wood.

5. An assembly as set forth in claim 1 wherein the elongate length segment is of plastic material.

6. An assembly as set forth in claim 1 wherein said upper surface of said buoyant float means is of a greater cross-sectional area than the lower end and said side surface, extending between the upper surface and lower end, tapers.

7. An assembly as set forth in claim 1 wherein said elongate length segment and said float are integral.

8. An assembly as set forth in claim 1 wherein handle means are provided on the float means extending upwardly from the upper surface thereof.

9. An assembly as set forth in claim 1 wherein said elongate length segment is between 2½ inches and 4½ inches in length.

10. An assembly as set forth in claim 1 wherein the cross-sectional of said main length is between 1/16 of an inch and ⅛ of an inch in diameter and said elongate length segment is of circular cross-section.

* * * * *